US011707826B2

(12) United States Patent
Chien et al.

(10) Patent No.: US 11,707,826 B2
(45) Date of Patent: Jul. 25, 2023

(54) RETAINING DEVICE FOR USE WITH A NAIL GUN

(71) Applicant: BASSO INDUSTRY CORP., Taichung (TW)

(72) Inventors: Chia-Yu Chien, Taichung (TW); Ching-Han Chang, Taichung (TW)

(73) Assignee: Basso Industry Corp., Taichung (TW)

( * ) Notice: Subject to any disclaimer, the term of this patent is extended or adjusted under 35 U.S.C. 154(b) by 2 days.

(21) Appl. No.: 17/573,052

(22) Filed: Jan. 11, 2022

(65) Prior Publication Data

US 2022/0219302 A1 Jul. 14, 2022

(30) Foreign Application Priority Data

Jan. 13, 2021 (TW) ..... 110101302

(51) Int. Cl.
*B25C 1/06* (2006.01)
*B25C 1/00* (2006.01)

(52) U.S. Cl.
CPC ..... *B25C 1/06* (2013.01); *B25C 1/008* (2013.01)

(58) Field of Classification Search
CPC ..... B25C 1/06
See application file for complete search history.

(56) References Cited

U.S. PATENT DOCUMENTS 3,924,692 A * 12/1975 Saari ..... B25C 1/06 173/117
RE29,354 E * 8/1977 Malkin ..... B25C 1/06 227/132
7,500,589 B2 3/2009 Wolf
7,992,756 B2 * 8/2011 Franz ..... B25C 5/15 227/132
10,442,066 B2 * 10/2019 Nishikawa ..... B25C 7/00
2002/0104869 A1 * 8/2002 Garvis ..... B25C 1/06 227/138
2007/0284406 A1 * 12/2007 Okouchi ..... B25C 1/06 227/132
2008/0017689 A1 * 1/2008 Simonelli ..... B25C 1/06 227/132

(Continued)

FOREIGN PATENT DOCUMENTS

EP 3181294 A1 6/2017
JP 2020082302 A 6/2020

OTHER PUBLICATIONS

Search Report issued to European counterpart application No. 22151184.3 by the EPO dated Jun. 3, 2022.

*Primary Examiner* — Nathaniel C Chukwurah
*Assistant Examiner* — Lucas E. A. Palmer
(74) *Attorney, Agent, or Firm* — Burris Law, PLLC

(57) ABSTRACT

A retaining device adapted for use with an electric nail gun includes: a swing arm unit adapted to swing relative to a flywheel of the nail gun; an impact unit adapted to swing with the swing arm unit, and being movable between a pre-striking position proximate to the flywheel, and a striking position distal from the flywheel; a retrieving unit configured to bias the impact unit to move to the pre-striking position; and first and second positioning members connected respectively to the swing arm unit and the impact unit, and telescopically engaged with and in frictional contact with each other when the impact unit is at the pre-striking position, so as to position the impact unit on the swing arm unit.

7 Claims, 7 Drawing Sheets

(56) References Cited

U.S. PATENT DOCUMENTS

| | | | | |
|---|---|---|---|---|
| 2009/0236387 | A1* | 9/2009 | Simonelli | B25F 5/006 227/8 |
| 2009/0250500 | A1* | 10/2009 | Brendel | B25C 5/15 227/132 |
| 2020/0246952 | A1* | 8/2020 | Chien | B25D 11/02 |
| 2021/0354278 | A1* | 11/2021 | Lai | B25D 11/068 |
| 2022/0040836 | A1* | 2/2022 | Chien | B25C 1/005 |
| 2022/0161405 | A1* | 5/2022 | Chien | B25C 1/06 |
| 2022/0176531 | A1* | 6/2022 | Chien | B25C 1/06 |

* cited by examiner

RETAINING DEVICE FOR USE WITH A NAIL GUN

CROSS-REFERENCE TO RELATED APPLICATION

This application claims priority of Taiwanese Patent Application No. 110101302, filed on Jan. 13, 2021.

FIELD

The disclosure relates to an electric nail gun, and more particularly to a retaining device for use with an electric nail gun having a flywheel.

BACKGROUND

A conventional electric nail gun disclosed in Japanese Patent Publication No. 2020082302 includes a flywheel that is rotatable by electric power, a driver that is configured to be driven by rotation of the flywheel to strike a nail, a returning mechanism that moves the driver to its original position after the striking, and a stopping mechanism that restricts movement of the driver after the driver returns to the original position. During a nail-striking process, the stopping member is disengaged from the driver, so that the driver can be pushed by a pushing member to contact a pressure roller. The pressure roller then pushes the driver to contact the flywheel to perform the striking operation.

When the nail-striking process is completed and the driver is moved to its original position by the returning mechanism, movement of the driver is restricted by the stopping mechanism such that the driver is prevented from being accidentally driven to strike the nail. However, the stopping mechanism of the conventional electric nail gun has a rather complex configuration, which makes it difficult for installation and maintenance.

SUMMARY

Therefore, the object of the disclosure is to provide a retaining device for use with an electric nail gun that has a simpler structure for easy installation and maintenance.

According to the disclosure, a retaining device is adapted for use with a nail gun. The nail gun includes a frame, and a flywheel that is rotatably mounted to the frame. The retaining device includes a swing arm unit, an impact unit, a retrieving unit and a positioning unit.

The swing arm unit is adapted to be pivoted to the frame, and is adapted to swing relative to the frame between a proximate position, where the swing arm unit is proximate to the flywheel, and a distal position, where the swing arm unit is distal from the flywheel. The impact unit is movably connected to the swing arm unit, is adapted to swing with the swing arm unit relative to the frame, and is movable in a striking direction, and a retrieving direction opposite to the striking direction between a pre-striking position, where the impact unit is proximate to the flywheel, and a striking position, where the impact unit is distal from the flywheel. The retrieving unit is connected between the impact unit and the swing arm unit, and is configured to bias the impact unit to move in the retrieving direction to the pre-striking position. The positioning unit includes at least one first positioning member that is connected to the swing arm unit and that extends along the striking direction, and at least one second positioning member that is connected to the impact unit, that extends along the striking direction, and that is configured to be telescopically engaged with and in frictional contact with the at least one first positioning member when the impact unit is at the pre-striking position, so as to position the impact unit on the swing arm unit.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
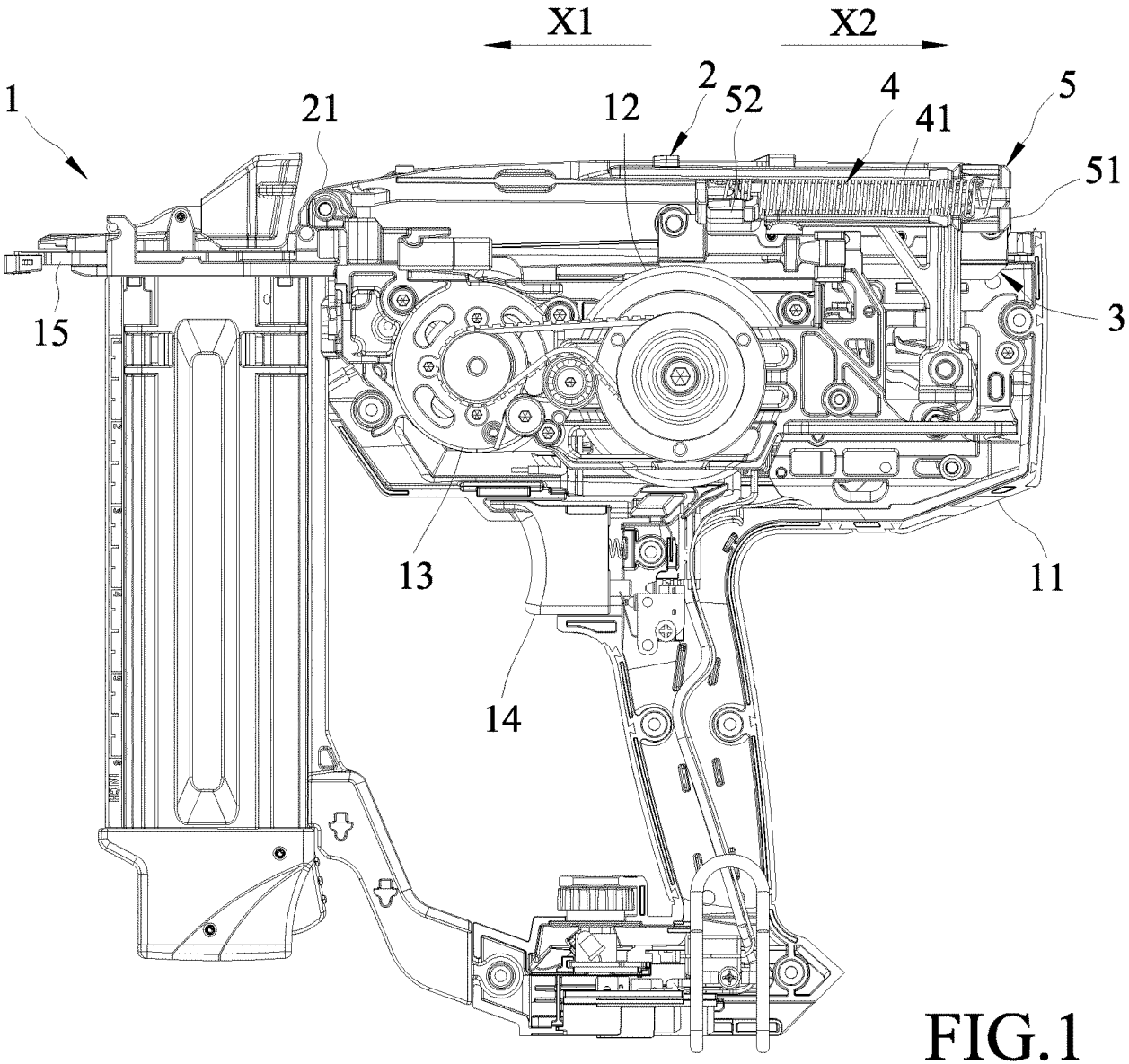
FIG. 1 is a schematic side view of an embodiment of a retaining device according to the disclosure being mounted in a nail gun.
Figure 2:
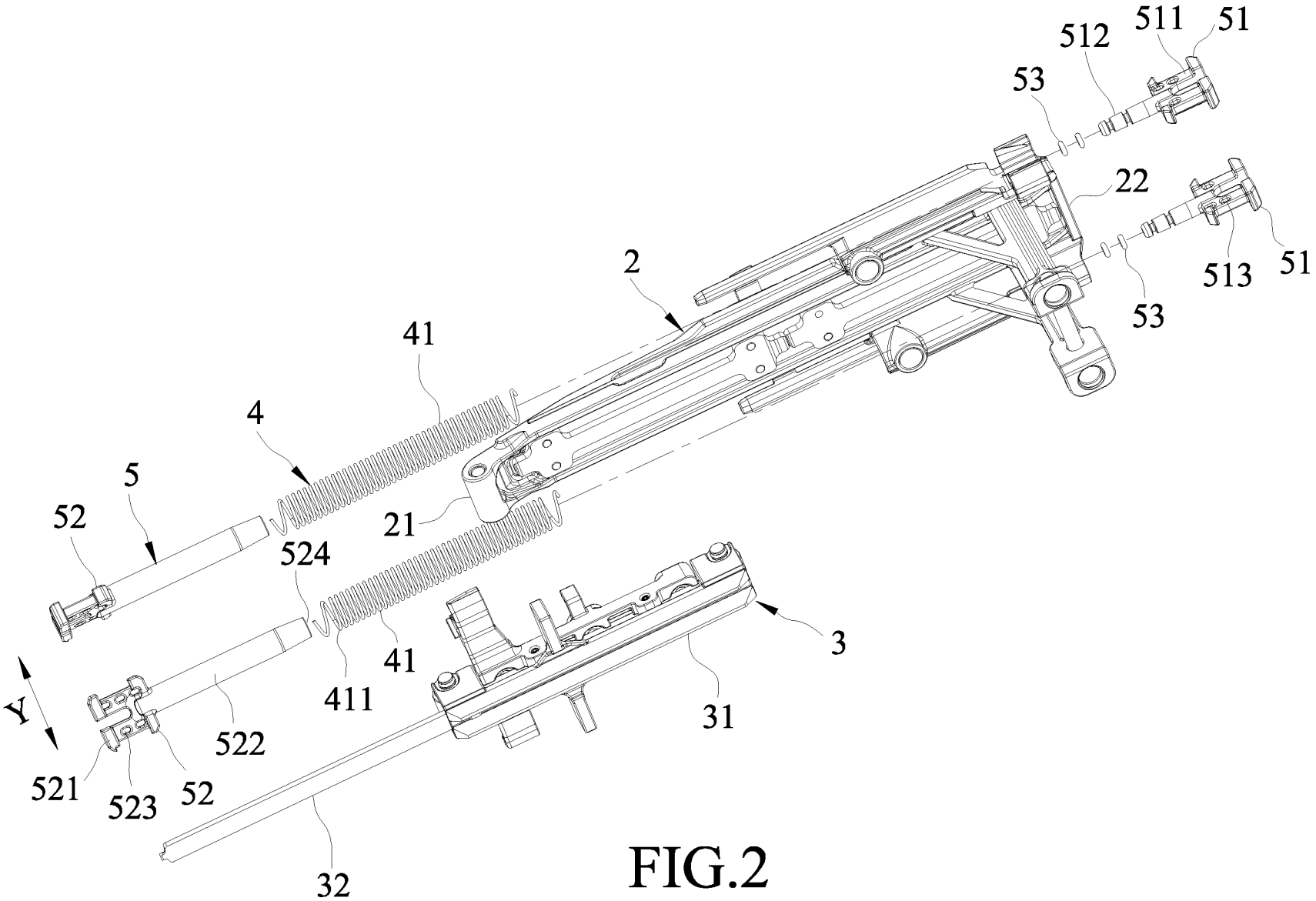
FIG. 2 is an exploded perspective view of the embodiment.
Figure 3:
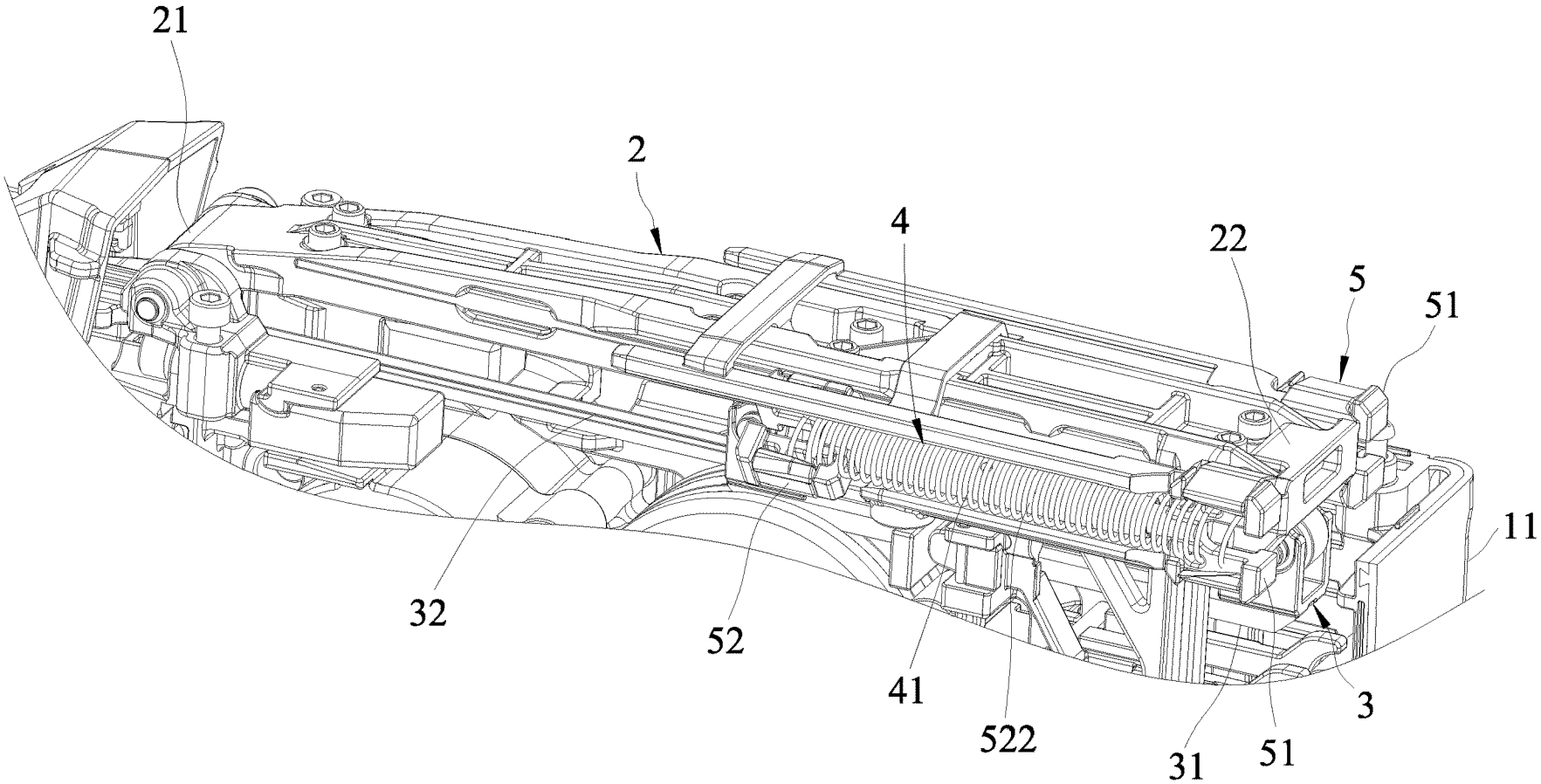
FIG. 3 is a fragmentary perspective view of the nail gun.

Referring to FIGS. 1, 2 and 3, an embodiment of a retaining device according to the disclosure is adapted for use in a electric nail gun 1. The nail gun 1 includes a frame 11, a flywheel 12 that is rotatably mounted to the frame 11, a motor unit 13 that drives the flywheel 12 to rotate by electric power, and a trigger unit 14 and a safety unit 15 that are movably installed on the frame 11 for manual operation. The trigger unit 14 and the safety unit 15 are configured to determine whether the motor unit 13 is activated and whether to perform a nail-striking action. The retaining device includes a swing arm unit 2, an impact unit 3, a retrieving unit 4, and a positioning member 5.

The swing arm unit 2 extends along a striking direction (X1) and is adapted to be spaced apart from the flywheel 12. The swing arm unit 2 includes a pivot portion 21 that is adapted to be pivoted to the frame 11, and a swinging portion 22 that is opposite to the pivot portion 21 and that is adapted to be spaced apart from the flywheel 12.

The swing arm unit 2 is adapted to be operated by the trigger unit 14 to swing relative to the frame 11 between a distal position (see FIGS. 1 and 4), where the swinging portion 22 is distal from the flywheel 12, and a proximate position (see FIGS. 5 and 6), where the swinging portion 22 is proximate to the flywheel 12.

The impact unit 3 is movably connected to the swing arm unit 2, and is adapted to swing with the swing arm unit 2 relative to the frame 11. The impact unit includes an impact member 31 that is movably connected to the swing arm unit 2, and a striking rod 32 that is co-movably connected to the impact member 31 and that is adapted for striking a nail (not shown).

The impact unit 3 is movable in the striking direction (X1) and a retrieving direction (X2) opposite to the striking direction (X1) between a pre-striking position (see FIGS. 4 and 5), where the impact member 31 of the impact unit 3 is proximate to the swinging portion 22 of the swing arm unit 2 and is proximate to the flywheel 12, and a striking position (see FIG. 6), where the impact member 31 is proximate to the pivot portion 21 of the swing arm unit 2 and is distal from the flywheel 12. When the impact unit 3 is at the pre-striking position and when the swing arm unit 2 swings from the distal position to the proximate position, the impact member 31 of the impact unit 3 is brought into contact with the flywheel 12 so as to be driven by rotation of the flywheel 12 to move toward the striking position.

The retrieving unit 4 includes two resilient members 41 that are connected between the swing arm unit 2 and the impact member 31 of the impact unit 3, that extend along the striking direction (X1), and that are spaced apart from each other along a transverse direction (Y) being transverse to the striking direction (X1). The resilient members 41 are configured to bias the impact unit 3 to move in the retrieving direction (X2) to the pre-striking position. In the present embodiment, each of the resilient members 41 is a spring and has a plurality of spring coils 411. The striking direction (X1) and the transverse direction (Y) are substantially perpendicular to each other.

It should be noted that the number of the resilient members 41 is not limited to two. In variations of the embodiment, the number of the resilient member 41 may be one or more than two.

The positioning unit 5 includes two first positioning members 51, two second positioning members 52 and a plurality of gaskets 53. The first positioning members 51 extend along the striking direction (X1), are spaced apart from each other along the transverse direction (Y), and are connected respectively and non-movably to opposite sides of the swing arm unit 2. The second positioning members 52 extend along the striking direction (X1), are spaced apart from each other along the transverse direction (Y), and are connected respectively and non-movably to opposite sides of the impact unit 3.

The first and second positioning members 51, 52 are connected among the resilient members 41 of the retrieving unit 4, the swing arm unit 2 and the impact unit 3. Specifically, each of the resilient members 41 has one end connected to the swing arm unit 2 via a respective one of the first positioning members 51 and the other end connected to the impact unit 3 via a respective one of the second positioning members 52.

Figure 4:
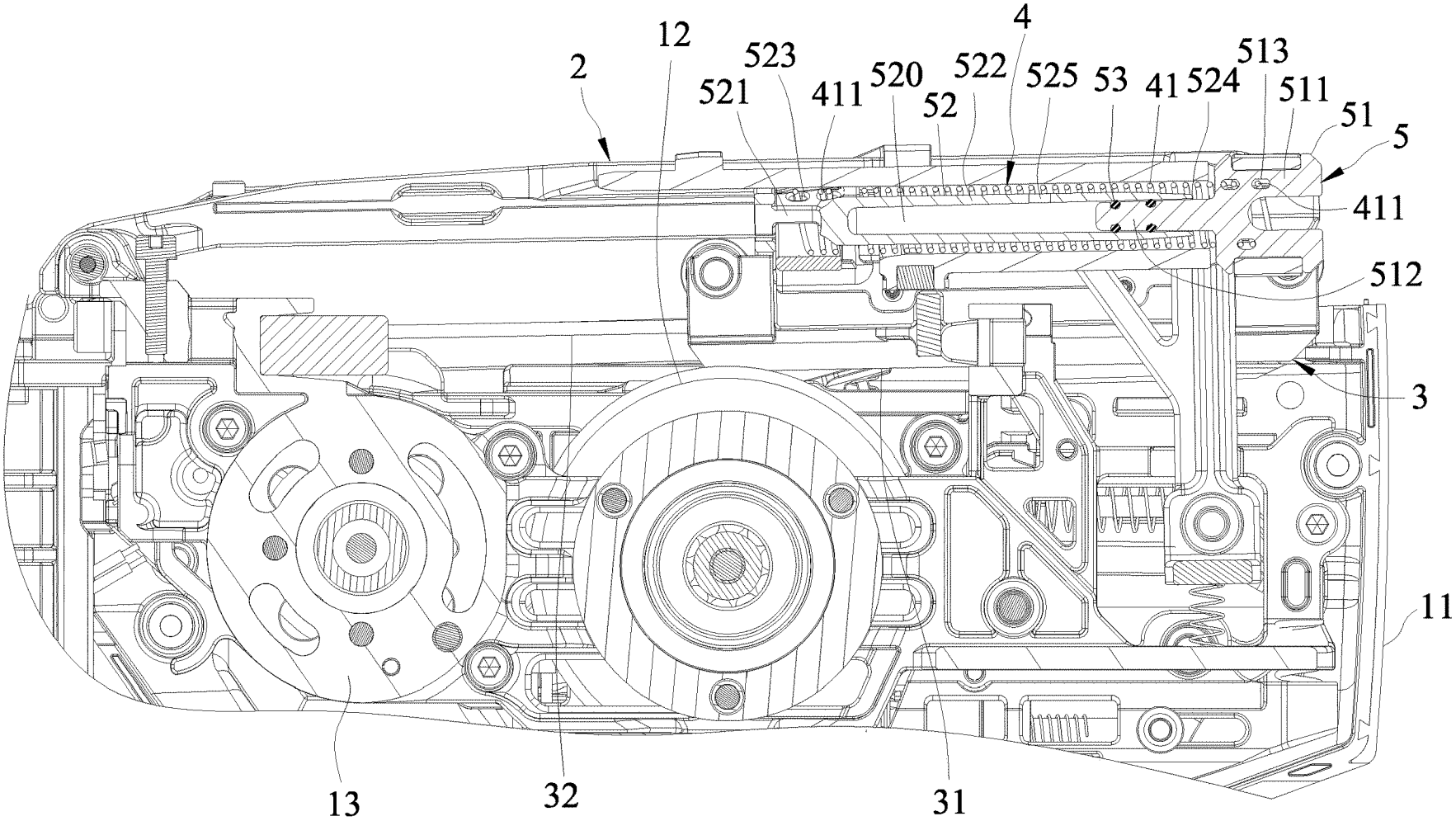
FIG. 4 is a fragmentary sectional view of the nail gun illustrating an impact unit being at a pre-striking position and a swing arm unit being at a distal position.
Figure 5:
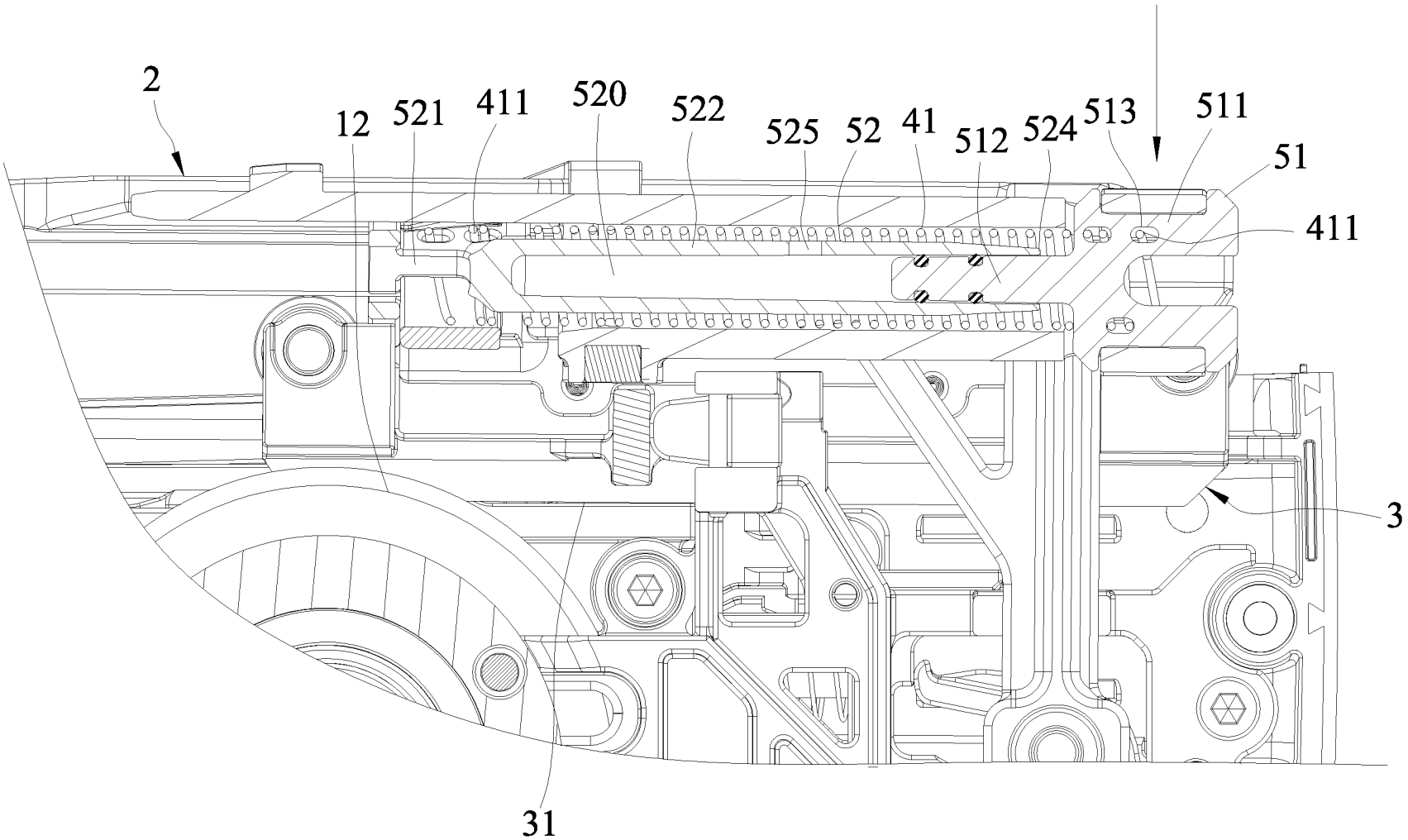
FIG. 5 is a fragmentary sectional view similar to FIG. 4, but illustrating that the swing arm unit is at a proximate position.
Figure 6:
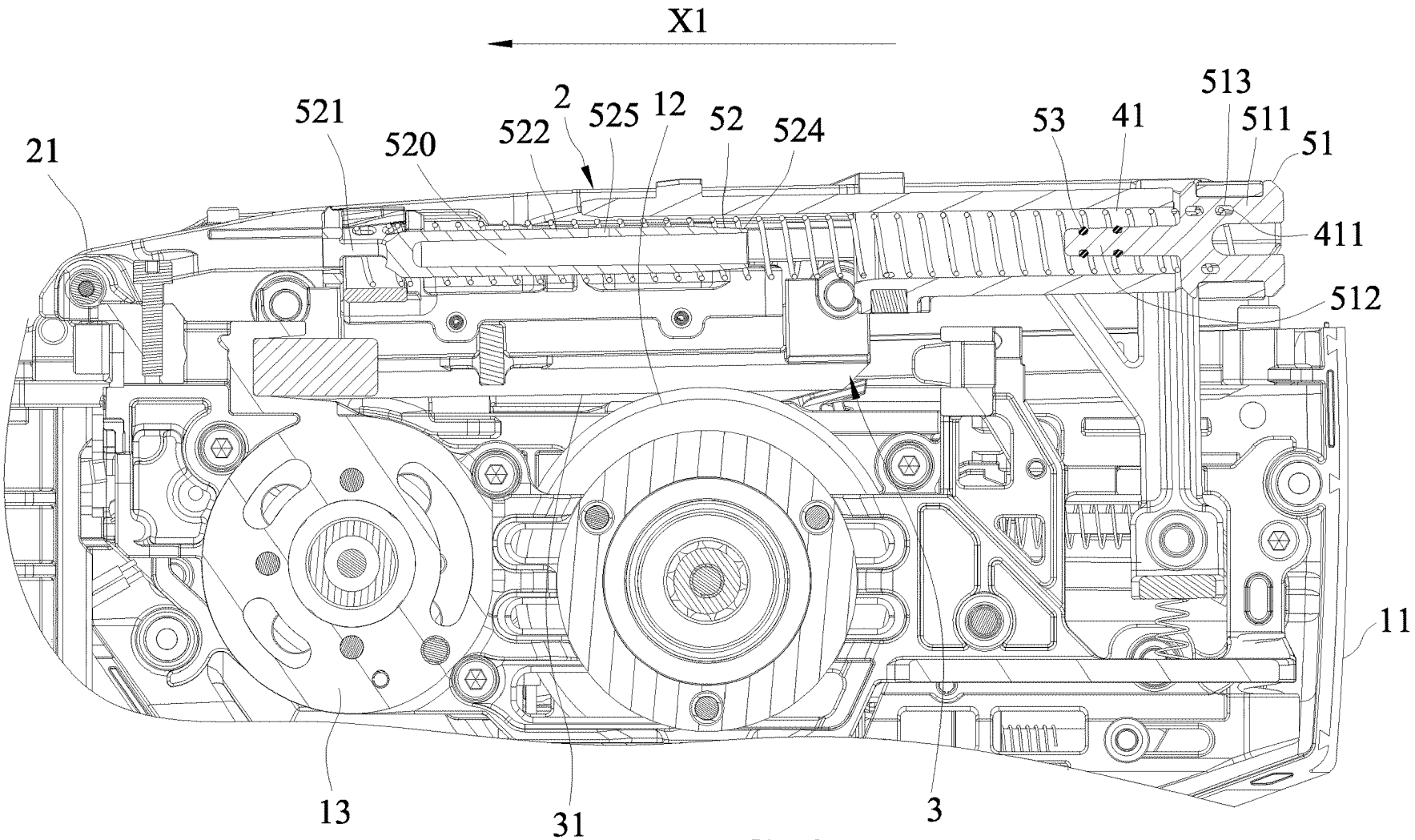
FIG. 6 is a fragmentary sectional view similar to FIG. 5, but illustrating that the impact unit is at a striking position.

When the impact unit 3 is at the pre-striking position, each of the second positioning members 52 is configured to be telescopically engaged with and in frictional contact with a respective one of the first positioning members 51, so as to position the impact unit 3 on the swing arm unit 2 (see FIGS. 4 and 5). When the impact unit 3 is at the striking position, each of the second positioning members 52 is configured to be spaced apart from the respective one of the first positioning members 51 (see FIG. 6).

Referring to FIGS. 2 and 4, each of the first positioning members 51 has a first connecting end portion 511 that is detachably connected to the swing arm unit 2, a rod portion 512 that is opposite to the first connecting end portion 511 along the striking direction (X1), and that extends along the striking direction (X1), and a plurality of first engaging holes 513 that are provided for one end of a respective one of the resilient members 41 to extend therethrough.

Each of the second positioning members 52 has a second connecting end portion 521 that is detachably connected to the impact unit 3, a surrounding wall portion 522 that is opposite to the second connecting end portion 521 along the retrieving direction (X2), and a plurality of second engaging holes 523 that are provided for the other end of the respective one of the resilient members 41 to extend therethrough. The surrounding wall portion 522 of each of the second positioning members 52 surrounds and defines a receiving room 520 that has an end 524 being open toward the respective one of the first positioning members 51, and is formed with an air discharging hole 525 that spatially communicates the receiving room 520 with the external environment.

Each of the gaskets 53 is sleeved on the rod portion 512 of one of the first positioning members 51 such that, when the impact unit 3 is at the pre-striking position, each of the gaskets 53 is disposed between and in frictional contact with the rod portion 512 of the one of the first positioning members 51 and the surrounding wall portion 522 of a corresponding one of the second positioning members 52 to provide an airtight seal.

It should be noted that the number of the first and second positioning members 51, 52 may vary as long as the number of the first positioning members 51 is the same as that of the second positioning members. It should also be noted that the resilient members 41 are not limited to be connected to the first and second positioning members 51, 52. In variations of the embodiment, the resilient members 41 may be directly connected to the swing arm unit 2 and the impact unit 3 without the first and second positioning members 51, 52.

Referring again to FIGS. 1 and 4, prior to an operation of the nail gun 1, the swing arm unit 2 is at the distal position (i.e., the swinging portion 22 of the swing arm unit 2 is distal from the flywheel 12) and the impact unit 3 is at the pre-striking position, such that the impact member 31 is proximate to and spaced apart from the flywheel 12. At this time, the rod portion 512 of each of the first positioning members 51 is received in the receiving room 520 of the respective one of the second positioning members 52 such that each of the first positioning members 51 is positioned relative to the respective one of the second positioning members 52 via friction between the corresponding gaskets 53 and the surrounding wall portion 522, thereby prohibiting removal of the impact unit 3 from the pre-striking position.

Referring to FIGS. 1 and 5, during the operation, when the flywheel 12 starts to rotate to a predetermined speed, a user may operate the trigger unit 14 to enter a single-striking mode, or operate both the trigger unit 14 and the safety unit 15 in order to enter a sequential-striking mode. Then, the swing arm unit 2 is driven to swing toward the flywheel 12 to the proximate position and bring the impact member 31 at the pre-striking position toward the flywheel 12. Once the impact member 31 is brought into contact with the flywheel 12, the impact unit 3 is urged by the rotation of the flywheel 12 to overcome the friction between the gaskets 53 and the second positioning members 52, so as to move in the striking direction (X1) from the pre-striking position toward the striking position (see FIG. 6). After the striking rod 32 of the impact unit 3 strikes the nail (not shown), the swing arm unit 2 returns from the proximate position to the distal position (see FIG. 7), and the impact unit 3 is subjected to the biasing force of the resilient members 41 to move in the retrieving direction (X2) from the striking position toward the pre-striking position.

Figure 7:
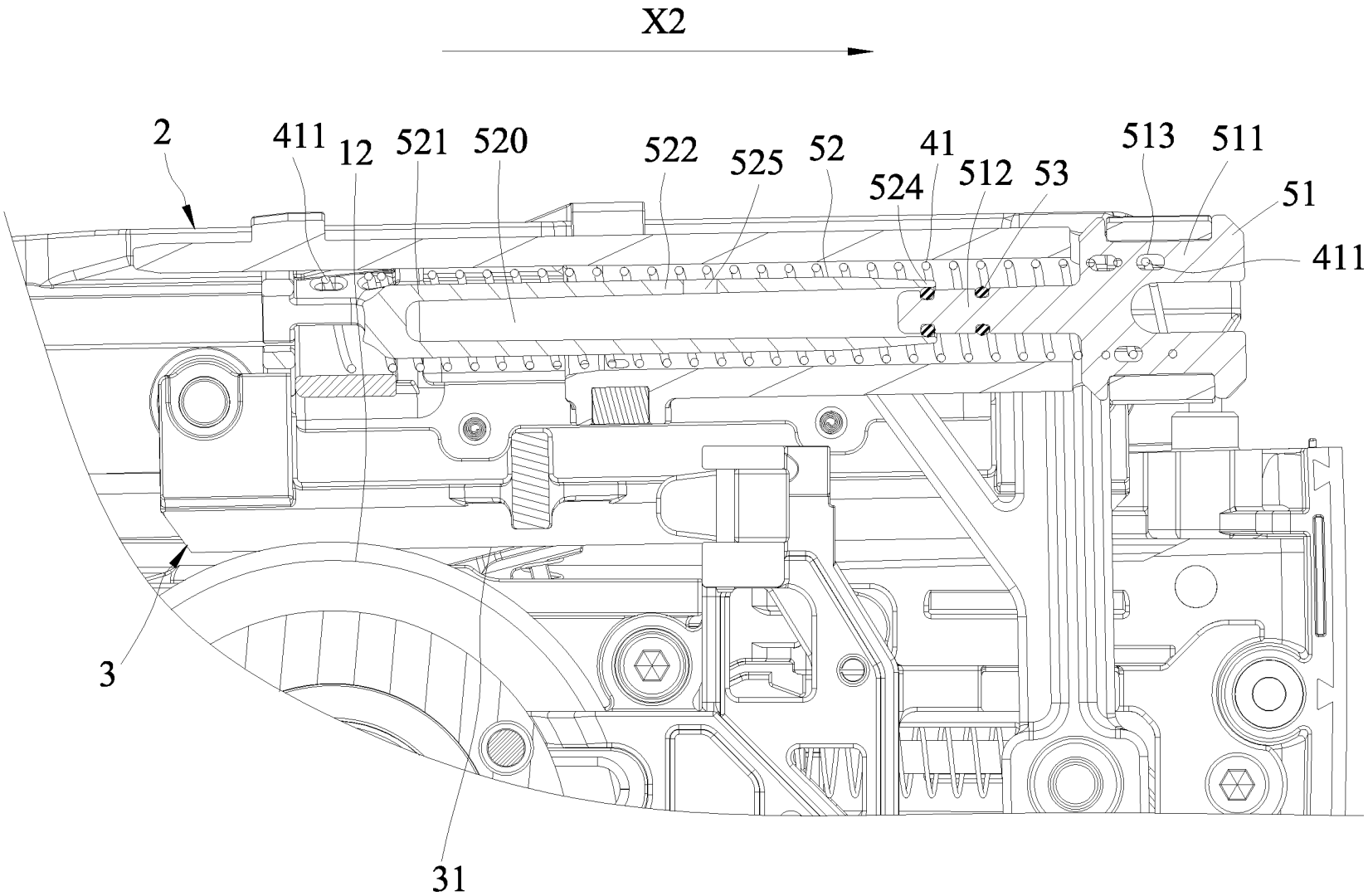
FIG. 7 is a fragmentary sectional similar to FIG. 6, but illustrating that the impact unit moves from the striking position toward the pre-striking position.

Specifically, referring to FIGS. 4 and 7, when the impact unit 3 is driven by the resilient members 41 to move toward the pre-striking position, the surrounding wall portion 522 of each of the second positioning members 52 becomes sleeved on the rod portion 512 of the respective one of the first positioning members 51 in an airtight manner, forcing a portion of air in the receiving room 520 to flow out through the air discharging hole 525 and generating a damping effect. As a result, the telescopic engagement between the first and second positioning members 51, 52 prohibits potential movement of the impact unit 3 caused by oscillatory motion of the resilient members 41, and thus prevents the impact unit 3 from accidentally striking the nail.

It should be noted that, since the impact unit 3 is configured to swing with the swing arm unit 2, the telescopic engagement between the first and second positioning members 51, 52 is not affected by the movement of the swing arm unit 2 between the distal position and the proximate position.

In sum, the present embodiment of the retaining device for use in the nail gun has benefits as follows. By virtue of the positioning effect provided by the first and second positioning members 51, 52, the impact unit 3 is prevented from accidentally striking the nail after returning from the striking position to the pre-striking position. In addition, compared with the prior art, the retaining device of the present disclosure is able to provide the same function with a simpler structure, which is easier for installation and maintenance.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A retaining device adapted for use with a nail gun, the nail gun including a frame, and a flywheel that is rotatably mounted to the frame, said retaining device comprising:

a swing arm unit that is adapted to be pivoted to the frame, and that is adapted to swing relative to the frame between a proximate position, where said swing arm unit is proximate to said flywheel, and a distal position, where said swing arm unit is distal from the flywheel;

an impact unit that is movably connected to said swing arm unit, that is adapted to swing with said swing arm unit relative to the frame, and that is movable in a striking direction, and a retrieving direction opposite to the striking direction between a pre-striking position, where said impact unit is proximate to said flywheel, and a striking position, where said impact unit is distal from said flywheel;

a retrieving unit that is connected between said impact unit and said swing arm unit, and that is configured to bias said impact unit to move in the retrieving direction to the pre-striking position; and a positioning unit that includes at least one first positioning member non-movably connected to said swing arm unit and extending along the striking direction, and at least one second positioning member non-movably connected to said impact unit, extending along the striking direction, and configured to be telescopically engaged with and in frictional contact with said at least one first positioning member when said impact unit is moving from the striking position towards the pre-striking position, so as to position said impact unit on said swing arm unit.

2. The retaining device as claimed in claim 1, wherein:

said at least one first positioning member has a rod portion that extends along the striking direction;

said at least one second positioning member has a surrounding wall portion that surrounds and defines a receiving room having an end which is open toward said at least one first positioning member, and that is formed with an air discharging hole spatially communicating said receiving room with the external environment; and when said impact unit moves in the retrieving direction from the striking position to the pre-striking position, said surrounding wall portion becomes sleeved on said rod portion in an airtight manner, forcing a portion of air in the receiving room to flow out through said air discharging hole and generating a damping effect.

3. The retaining device as claimed in claim 2, wherein said positioning unit further includes a plurality of gaskets, each of said gaskets being disposed between and in frictional contact with said rod portion of said at least one first positioning member and said surrounding wall portion of said at least one second positioning member to provide an airtight seal between said first and second positioning members.

4. The retaining device as claimed in claim 2, wherein said retrieving unit is connected to said swing arm unit via said at least one first positioning member, and is connected to said impact unit via said at least one second positioning member, said at least one second positioning member being spaced apart from said at least one first positioning member when said impact unit is at the striking position.

5. The retaining device as claimed in claim 4, wherein:

said retrieving unit includes two resilient members, said resilient members extending along the striking direction and being spaced apart from each other along a transverse direction, the transverse direction being substantially perpendicular to the striking direction; and said positioning unit includes two of said first positioning members and two of said second positioning members, each of said resilient members having one end connected to a respective one of said first positioning members and the other end connected to a respective one of said second positioning members.

6. The retaining device as claimed in claim 5, wherein:

each of said first positioning members further has a first connecting end portion that is opposite to said rod portion along the retrieving direction and that is detachably connected to said swing arm unit; and each of said second positioning member further has a second connecting end portion that is opposite to said surrounding wall portion along the striking direction and that is detachably connected to said impact unit.

7. The retaining device as claimed in claim 5, wherein:

each of said resilient members has a plurality of spring coils;

each of said first positioning members further has at least one first engaging hole that is provided for one end of said spring coils of the respective one of said resilient members to extend therethrough; and each of said second positioning members further has at least one second engaging hole that is provided for the other end of the respective one of said resilient members to extend therethrough.

* * * * *